US009763495B2

(12) United States Patent
Takada et al.

(10) Patent No.: US 9,763,495 B2
(45) Date of Patent: Sep. 19, 2017

(54) UPPER OF SHOE

(71) Applicant: Asics Corporation, Kobe-shi (JP)

(72) Inventors: Yasuyuki Takada, Kobe (JP); Shingo Masumoto, Kobe (JP); Mai Nonogawa, Kobe (JP)

(73) Assignee: ASICS CORPORATION (JP)

( * ) Notice: Subject to any disclaimer, the term of this patent is extended or adjusted under 35 U.S.C. 154(b) by 0 days.

(21) Appl. No.: 15/302,138

(22) PCT Filed: Apr. 11, 2014

(86) PCT No.: PCT/JP2014/060485
§ 371 (c)(1),
(2) Date: Oct. 5, 2016

(87) PCT Pub. No.: WO2015/155882
PCT Pub. Date: Oct. 15, 2015

(65) Prior Publication Data
US 2017/0119101 A1 May 4, 2017

(51) Int. Cl.
*A43C 1/00* (2006.01)
*A43B 23/02* (2006.01)
*A43B 23/22* (2006.01)

(52) U.S. Cl.
CPC ..... *A43B 23/027* (2013.01); *A43B 23/0245* (2013.01); *A43B 23/0275* (2013.01); *A43B 23/22* (2013.01); *A43C 1/00* (2013.01)

(58) Field of Classification Search
CPC . A43B 23/0235; A43B 23/0245; A43B 23/22; A43B 23/00; A43C 5/00; A43C 1/00
(Continued)

(56) References Cited

U.S. PATENT DOCUMENTS 2,147,197 A * 2/1939 Glidden ..... A43B 1/02 36/3 A
3,768,182 A * 10/1973 Powers ..... A43B 5/00 36/114

(Continued)

FOREIGN PATENT DOCUMENTS

JP S33-03132 U 3/1958
JP S63-127408 U 8/1988

(Continued)

OTHER PUBLICATIONS

International Search Report and Written Opinion Issued in PCT/JP2014/060485 dated Jul. 15, 2014.

*Primary Examiner* — Marie Bays
(74) *Attorney, Agent, or Firm* — Katten Muchin Rosenman LLP

(57) ABSTRACT

An upper including: a cord placed along the longitudinal direction, the cord running through the through holes of the reinforcement members of the medial side portion and/or the lateral side portion; exposed areas in which portions of the cord are placed exposed; and a shoelace engaging with the cord in the exposed areas in a transverse direction of the foot so as to bring the medial side portion and the lateral side portion closer to each other, wherein each of the upper end portions of at least one reinforcement member is attached to the flexible member in one of a fore portion and a rear portion, and is set to be un-attached to the flexible member in the other one of the fore portion and the rear portion.

18 Claims, 10 Drawing Sheets

(58) Field of Classification Search
USPC ..... 36/45, 50.1
See application file for complete search history.

(56) References Cited

U.S. PATENT DOCUMENTS

| | | | | | |
|---|---|---|---|---|---|
| 4,447,967 | A * | 5/1984 | Zaino | A43B 23/0235 | 36/45 |
| 4,670,998 | A * | 6/1987 | Pasternak | A43B 7/1495 | 36/114 |
| 5,371,957 | A * | 12/1994 | Gaudio | A43B 11/00 | 36/45 |
| 5,377,430 | A * | 1/1995 | Hatfield | A43B 3/08 | 24/714.6 |
| 5,497,564 | A * | 3/1996 | Allen | A43C 5/00 | 24/713.7 |
| 5,692,319 | A * | 12/1997 | Parker | A43B 7/1495 | 36/114 |
| 6,826,851 | B2 * | 12/2004 | Nelson, Jr. | A43B 5/005 | 24/712 |
| 7,073,279 | B2 * | 7/2006 | Min | A43C 1/003 | 24/712 |
| 7,624,517 | B2 * | 12/2009 | Smith | A43B 7/14 | 36/50.1 |
| 7,810,257 | B2 * | 10/2010 | Candrian | A43B 1/0027 | 36/100 |
| 8,001,704 | B2 * | 8/2011 | Baudouin | A43B 7/1495 | 36/102 |
| 8,533,976 | B2 * | 9/2013 | Fuerst | A43B 1/14 | 36/11.5 |
| 8,656,606 | B2 * | 2/2014 | Hooper | A43B 7/06 | 36/102 |
| D701,031 | S | 3/2014 | Grenet | | |
| 8,667,713 | B2 * | 3/2014 | Baudouin | A43B 7/1495 | 36/102 |
| 8,756,833 | B2 * | 6/2014 | Heard | A43C 1/04 | 24/714.7 |
| 8,806,776 | B2 * | 8/2014 | Leick | A43B 1/0081 | 12/142 LC |
| 2006/0162190 | A1 | 7/2006 | Nishiwaki et al. | | |
| 2015/0026937 | A1 | 1/2015 | Nonogawa et al. | | |

FOREIGN PATENT DOCUMENTS

| | | | |
|---|---|---|---|
| JP | H03-055710 | U | 5/1991 |
| JP | H03-87408 | U | 9/1991 |
| JP | 2001-054409 | A | 2/2001 |
| JP | 4918571 | B2 | 4/2012 |
| WO | WO-2007-002068 | A2 | 1/2007 |
| WO | WO-2013-136514 | A1 | 9/2013 |

* cited by examiner

UPPER OF SHOE

CROSS-REFERENCES TO RELATED APPLICATIONS

This patent application is a U.S. National Phase application under 37 U.S.C. §371 of Patent Cooperation Treaty Application No. PCT/JP2014/060485, filed on Apr. 11, 2014, entitled "SHOE UPPER," the contents of which are incorporated herein by reference in entirety.

TECHNICAL FIELD

The present invention relates to an upper of a shoe, and more particularly to an upper of a shoe having a lace fitting structure.

BACKGROUND ART

A shoelace fits an upper to a foot. The upper fitted to the foot supports the foot. In view of this, a flexible member covering the instep is often provided with a reinforcement member.

However, the foot substantially changes its shape when dorsiflexed at the MP joint, and gaps are likely to occur between the shoe and the foot during movement.

As the posture changes, the shape substantially changes over an area from the MP joint to the middle foot section of the foot. If the upper, which is fitted to the foot when standing still, fails to follow changes of the shape of the foot, the fit between the upper and the foot significantly deteriorates during movement. Particularly, the reinforcement member has a greater rigidity than the flexible member, and is therefore less likely to follow changes than the flexible member.

CITATION LIST

Patent Literature

First Patent Document: WO2007/002068A1 (FIGS. 1 to 3)

Second Patent Document: Japanese Utility Model Publication for Opposition No. 33-3132 (FIG. 2)

Third Patent Document: JP2001-54409A (front page)

Fourth Patent Document: JP03-55710Y (FIG. 1)

Fifth Patent Document: WO2013/136514A1 (front page)

Sixth Patent Document: USD701,0315 (front page)

SUMMARY OF INVENTION

It is an object of the present invention to provide an upper of which a flexible member and a reinforcement member better fit to the foot when the foot is dorsiflexed, for example.

The present invention is directed to an upper for fitting, to an instep of a foot, a flexible member covering at least a portion of the instep, the upper including:

a medial side portion 31 covering a medial side surface of the instep;

a lateral side portion 32 covering a lateral side surface of the instep;

a flexible member 3F, which is flexible, covering at least a portion of the instep in the medial side portion 31 and/or the lateral side portion 32;

at least one reinforcement member 3L having a greater rigidity than the flexible member 3F, at least a lower half portion 39 of the reinforcement member 3L attached to a surface of the flexible member 3F in the medial side portion 31 and/or the lateral side portion 32, wherein the at least one reinforcement member 3L includes a plurality of upper end portions 4 spaced apart (separated) from one another in a longitudinal direction Y of the foot, and a through hole H passing through (piercing, running through) the reinforcement member 3L is defined in each of the upper end portions 4 in a direction normal to a surface of the reinforcement member 3L;

a cord 1 provided along a central edge portion 33 of the medial side portion 31 and/or the lateral side portion 32, the cord 1 inserted (running) through the through holes H of the medial side portion 31 and/or the lateral side portion 32 and placed along the longitudinal direction Y, wherein portions of the cord 1 include exposed areas 10 which are placed exposed; and a shoelace 2 for engaging with the cord 1 in the exposed areas 10 in a transverse direction X of the foot so as to bring the medial side portion 31 and the lateral side portion 32 closer to each other, wherein each of the upper end portions 4 of the at least one reinforcement member 3L is attached to the flexible member 3F in one of a fore (front) portion 4F and a rear portion 4R, and is set to be un-attached (non-attached, without attached) to the flexible member 3F in another (the other) one of the fore portion 4F and the rear portion 4R.

In the present invention, "each of the upper end portions 4 of the at least one reinforcement member 3L is attached to the flexible member 3F in one of a fore portion 4F and a rear portion 4R, and is set to be un-attached to the flexible member 3F in the other one of the fore portion 4F and the rear portion 4R" means to include at least the following three cases:

Case 1: all upper end portions 4 are attached to the flexible member 3F only along the fore portions 4F.

Case 2: all upper end portions 4 are attached to the flexible member 3F only along the rear portions 4R.

Case 3: there are upper end portions 4 attached to the flexible member 3F only along the fore portions 4F and other upper end portions 4 attached to the flexible member 3F only along the rear portions 4R.

Herein, the term "cord" means one or more strings (laces, strand) that can be used as a shoelace, and the cord may be knitted natural yarn (threads) or knitted polymer synthetic yarn (threads), or may be one or more strings of a natural leather, a synthetic resin wire or a synthetic leather, and may include a metal wire or a resin wire therein. In the present invention, the cord preferably includes a metal wire therein.

According to the present invention, the exposed areas of the cord form lacing apertures, through which the shoelace passes, and the exposed areas are placed over the instep of the foot anterior to the wearing opening (opening for wearing), so that the medial side portion and the lateral side portion of the upper better fit to the foot in an area anterior to the wearing opening.

The medial side portion and the lateral side portion are pulled toward the center (of the instep) by the shoelace in the central-side edge portion of each side portion, so that the medial side portion and the lateral side portion of the upper better fit to the foot.

The reinforcement member 3L is attached to the flexible member 3F in the lower half portion 39 of the reinforcement member 3L, and the upper end portion 4 of the reinforcement member 3L is attached to the flexible member 3F in one of the fore portion 4F and the rear portion 4R, and is set to be un-attached to the flexible member 3F in the other one of the fore portion 4F and the rear portion 4R. Since the reinforcement member 3L is attached to the flexible member 3F over a wide area as described above, it will be possible to prevent the reinforcement member 3L from being inadvertently shifted from the flexible member 3F.

Herein, if both of the fore portion 4F and the rear portion 4R of the upper end portion 4 of the reinforcement member 3L are attached to the flexible member 3F, it will be difficult to pass the cord 1 through the through hole H of the upper end portion 4. On the other hand, if both of the fore portion 4F and the rear portion 4R of the upper end portion 4 are un-attached (not attached) to the flexible member 3F, the upper end portion 4 of the reinforcement member 3L will easily be displaced or deformed inadvertently with respect to the flexible member 3F during the movement of dorsiflexion described above.

In contrast, according to the present invention, the upper end portion 4 is attached to the flexible member 3F in only one of the fore portion 4F and the rear portion 4R of the upper end portion 4. Therefore, the cord 1 can be inserted through the through hole H of the upper end portion 4.

Particularly, the attachment to the flexible member 3F is made in one of the fore portion 4F and the rear portion 4R of the upper end portion 4, and therefore, the upper end portion 4 will move together with the flexible member 3F during the movement of dorsiflexion described above.

Moreover, since the other one of the fore portion 4F and the rear portion 4R of the upper end portion 4 is un-attached (not attached, without attached) to the flexible member 3F, the area of the flexible member 3F, which is flexible, covered by the upper end portion 4 will be deformable. Therefore, the flexible member 3F can deform in conformity with the substantial deformation of the foot when dorsiflexed, for example, thereby allowing for such displacement that upper end portions 4 that are adjacent to each other come close to each other or overlap with each other, as seen from the side, when dorsiflexed, for example.

Thus, this upper will better fit to the foot and will better support the foot in a stationary standing position and during movement such as when dorsiflexed.

DESCRIPTION OF EMBODIMENTS

Figure 1:
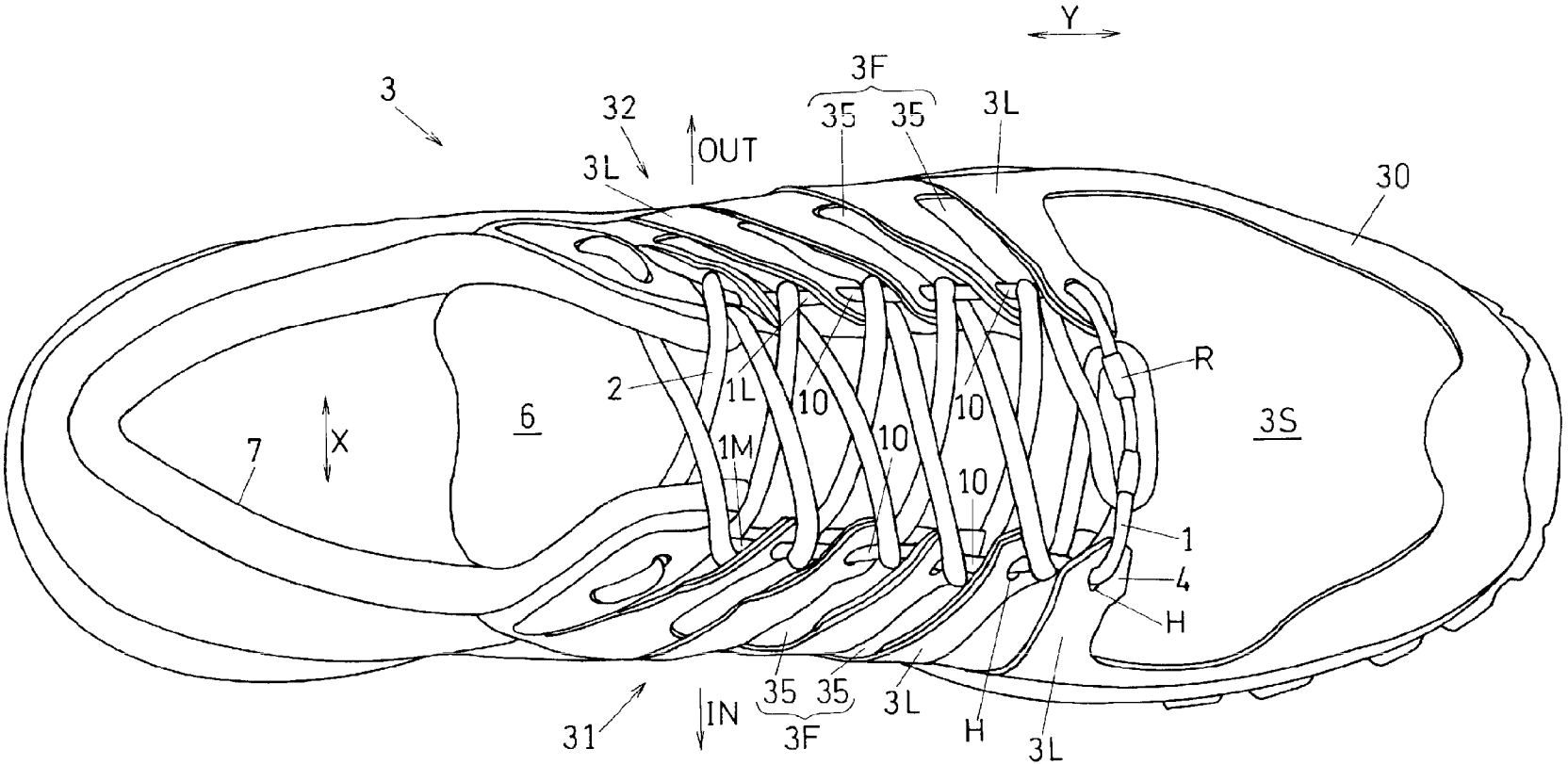
FIG. 1 is a schematic plan view of an upper according to an embodiment of the present invention.

Preferably, each of the upper end portions 4 of the at least one reinforcement member 3L is attached to the flexible member 3F in only one of the fore portion 4F and the rear portion 4R among the fore portion 4F, the rear portion 4R, and a top (distal) edge 40 of each of the upper end portions 4 that is on a top (distal) side with respect to the through hole H.

In such a case, the top edge 40 of the upper end portion 4 is un-attached (not attached) to the flexible member 3F, thereby allowing the upper end portion 4 to be easily displaced or deformed. Moreover, it is possible to easily insert the cord 1 through the through hole H of the upper end portion 4.

Preferably, one of the following (a) and (b) is set:

(a) each of the upper end portions 4 of the at least one reinforcement member 3L is attached to the flexible member 3F in the fore portion 4F, and is set to be un-attached to the flexible member 3F in the rear portion 4R, (b) each of the upper end portions 4 of the at least one reinforcement member 3L is attached to the flexible member 3F in the rear portion 4R, and is set to be un-attached to the flexible member 3F in the fore portion 4F.

In such a case, only the fore portion 4F or the rear portion 4R of the upper end portion 4 of each reinforcement member 3L is attached to the flexible member 3F, and the attached portions of the reinforcement members 3L that are adjacent to each other can be placed at a predetermined interval. As a result, one can expect deformation of the flexible member 3F between the reinforcement members 3L.

Preferably, each of the upper end portions 4 is set to be un-attached to the flexible member 3F in a top (distal) edge 40 of each of the upper end portions 4 that is on a top (distal) side with respect to the through hole H.

In such a case, the top edge 40 of the upper end portion 4 is un-attached (not attached) to the flexible member 3F, thereby allowing the upper end portion 4 to be easily displaced or deformed. Moreover, it is possible to easily insert the cord 1 through the through hole H of the upper end portion 4.

Preferably, between two of the through holes H that are adjacent to each other in the longitudinal direction Y, the cord 1 is placed on a back (inner) side 4*b* of one of the upper end portions 4 and on a front (outer) side 4*s* of another (the other) one of the upper end portions 4, thereby forming, between the cord 1 and the flexible member 3F, a space S, through which the shoelace 2 passes.

With such an arrangement of the cord 1, it will be easy to ensure sufficient lengths of the exposed areas 10. Therefore, a predetermined degree of the aforementioned displacement or deformation can be expected.

Moreover, it will be easy to ensure a sufficient size of the space S through which the shoelace 2 passes. Therefore, it will be easy to pass the shoelace 2 engaging with the exposed area 10.

Preferably, between two of the plurality of through holes H that are adjacent to each other in the longitudinal direction Y, the cord 1 is placed on a back (inner) side 4*b* of one of the upper end portions 4 and on a front (outer) side 4*s* of another (the other) one of the upper end portions 4, whereby, of the two (i.e., the one and the other) upper end portions 4 that are adjacent to each other, the back side 4*b* of the one of the upper end portions 4 and the front side 4*s* of the other one of the upper end portions 4 are placed at least partially facing each other.

Herein, "of the two upper end portions 4 that are adjacent to each other, the back side 4*b* of one of the upper end portions 4 and the front side 4*s* of the other one of the upper end portions 4 are placed at least partially facing each other" means that two upper end portions 4 and 4 that are adjacent to each other are not placed on a single virtual plane, and when the front (outer) side of one upper end portion 4 is seen from the normal direction thereto, at least a portion of the front side 4*s* of the other upper end portion 4 is hidden and not visible.

In the case of this preferred embodiment, two upper end portions 4 and 4 that are adjacent to each other will likely be placed on a pair of planes that are generally parallel to each other, with the shoelace 2 removed. Therefore, it will be easy to ensure the exposed area 10 of the cord 1, and it will therefore be easy to insert the cord 1 through the space S between the exposed area 10 and the flexible member 3F.

Preferably, between two of the plurality of through holes H that are adjacent to each other in the longitudinal direction Y, the cord 1 is placed on a back (inner) side 4*b* of one of the upper end portions 4 and on a front (outer) side 4*s* of another (the other) one of the upper end portions 4, whereby:

a space S, through which the shoelace 2 passes, is formed between the cord 1 and the flexible member 3F; and of the two upper end portions 4 that are adjacent to each other, the back side 4*b* of the one of the upper end portions 4 and the front side 4*s* of the other one of the upper end portions 4 are placed at least partially facing each other.

In such a case, one can expect advantageous effects as described above.

Preferably, a tensile rigidity of the cord 1 is greater than a tensile rigidity of the shoelace 2.

If the tensile rigidity of the cord 1 is small, the cord 1 may substantially (considerably) stretch or bend when the foot is dorsiflexed, and the fastening force of the shoelace 2 may not easily be transferred to the reinforcement members 3L. In contrast, if the tensile rigidity of the cord 1 is greater than that of the shoelace 2, the fastening force of the shoelace 2 will easily be transferred to the reinforcement members 3L.

Preferably, two of the upper end portions 4 that are adjacent to each other in the longitudinal direction Y partially overlap with each other as seen from the side.

In such a case, since upper end portions 4 that are adjacent to each other overlap with each other, as seen from the side, the size of the upper end portions 4 can be increased in the direction in which the cord 1 extends. Therefore, it is easy to form the through holes H, and it is easy to ensure the space S between the cord 1 and the flexible member 3F.

Preferably, the at least one reinforcement member 3L includes a strip (band, strap) portion 37 having a strip (strip-like, band) shape extending from each of the upper end portions 4 toward a sole 8; and each of the upper end portions 4, which is an upper end of the strip portion 37, includes a protruding portion 41 protruding forward and/or rearward.

In such a case, the strip portion 37 and the strip portion 37 adjacent to each other can easily be placed while being spaced apart from each other in the longitudinal direction. The protruding portion 41 also makes it easy to form the through hole H, and it is easy to ensure the space S between the cord 1 and the flexible member 3F.

Preferably, the at least one reinforcement member 3L includes a strip portion 37 having a strip (strip-like) shape and extending from each of the upper end portions 4 toward a sole 8;

each of the upper end portions 4, which is an upper end of the strip portion 37, includes a protruding portion 41 protruding forward and/or rearward; and two of the upper end portions 4 that are adjacent to each other in the longitudinal direction Y overlap with each other via the protruding portion 41 as seen from the side.

In such a case, one can expect advantageous effects as described above.

Preferably, the at least one reinforcement member 3L includes a plurality of strip portions 37 each having a strip (strip-like) shape and extending in a downward direction or in a diagonally downward direction from the upper end portions 4 along the medial side surface or the lateral side surface; and the upper further comprises a flexible portion 35 where the flexible member 3F is exposed between two of the plurality of strip portions 37 that are adjacent to each other in the longitudinal direction Y.

In such a case, the flexible portion 35 between two strip portions 37 adjacent to each other will be allowed to freely deform forward/rearward and upward/downward when the pair of strip portions 37 are displaced.

Therefore, the strip portion 37 will easily be displaced in accordance with the deformation of the foot during movement of the foot, e.g., dorsiflexion. That is, the strip portion 37 is likely to follow the movement of the foot, and one can expect a good fitting property.

Preferably, an area of the flexible portion 35 in a dorsiflexed state of a shoe is smaller than an area of the flexible portion 35 in a standstill (stationary standing) position.

In such a case, when the shoe is dorsiflexed, the upper edge (the edge portion 33) of an upper 3 opposite from the sole is bent and shrunk in the longitudinal direction in an area corresponding to the instep, and one can expect an even better fitting property.

Preferably, each of the upper end portions 4 is placed in a forwardly-tilting (-leaning) orientation, extending in a diagonally rearward direction from each of the upper end portions 4 toward a sole 8; and a posterior one (ones) of the upper end portions 4 tilts (leans) more forward than an anterior one (ones) of the upper end portions 4.

The slope of the ridge of the instep gradually increases rearward of the MP joint, and moreover, the hallucal extensor tendon (the extensor hallucis longus tendon) rises upward in the middle foot portion. In view of such a structure of the instep, a plurality of upper end portions 4 will make the flexible member 3F better fit to the instep if a posterior one of the upper end portions 4 is in a more forwardly-leaning orientation than an anterior one of the upper end portions 4.

Preferably, the at least one reinforcement member 3L includes a plurality of strip portions 37 each having a strip (strip-like) shape and extending from the upper end portions 4 in a downward direction or a diagonally downward direction along the medial side surface or the lateral side surface; and two of the strip portions 37 that are adjacent to each other in the longitudinal direction Y have their lower end portions 38, opposite from the upper end portions 4, lying continuous with each other in the longitudinal direction or a diagonally longitudinal direction in the lower end portions 38.

In such a case, on the medial side surface, the lower end portions 38 continuous with each other will be able to cover and support the ball of the big toe from the side, whereas on the lateral side surface, they will be able to cover and support the ball of the little toe from the side. Therefore, the support of the foot is likely to be stable.

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

EMBODIMENTS

Embodiments

Embodiments of the present invention will now be described with reference to FIG. 1 to FIG. 9.

An upper for the left foot will be illustrated in the following description. In the following figures, the arrow OUT represents the lateral side direction of the foot, and the arrow IN represents the medial side direction of the foot.

Figure 2:
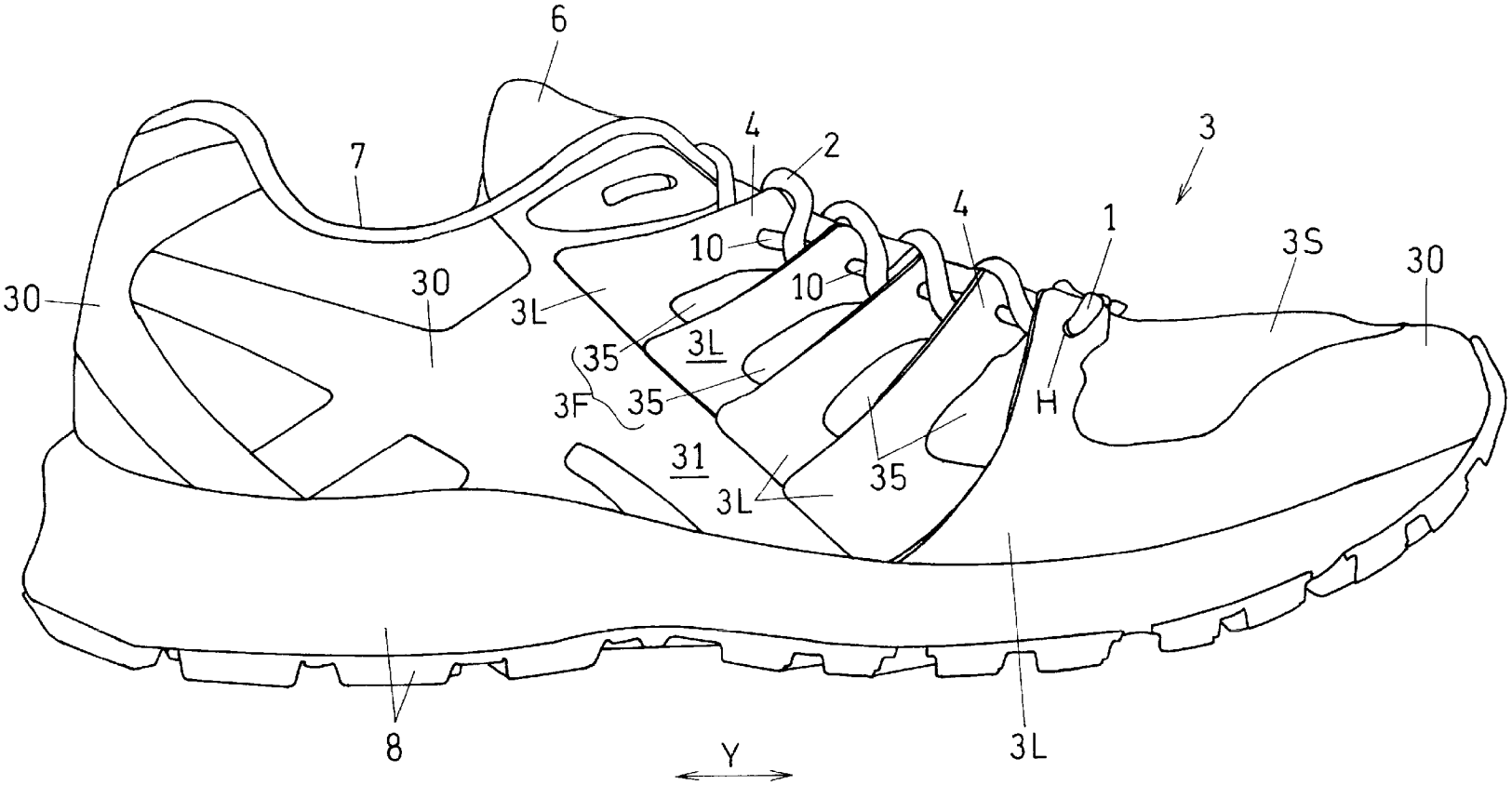
FIG. 2 is a schematic side view of the upper of the embodiment, as seen from the medial side.

A shoe having the lace fitting structure shown in FIG. 1 is a shoe for trail running, for example, and an upper 3 is secured to a sole 8 of FIG. 2. The upper 3 includes a cord 1 and a shoelace 2.

The sole 8 is placed under the upper 3, and comes into contact with the road surface. The upper 3 includes a flexible member 3F and a tongue 6 covering at least a portion of the instep of the foot. The cord 1 and the shoelace 2 are provided for fitting the flexible member 3F to the instep of the foot.

Figure 10:
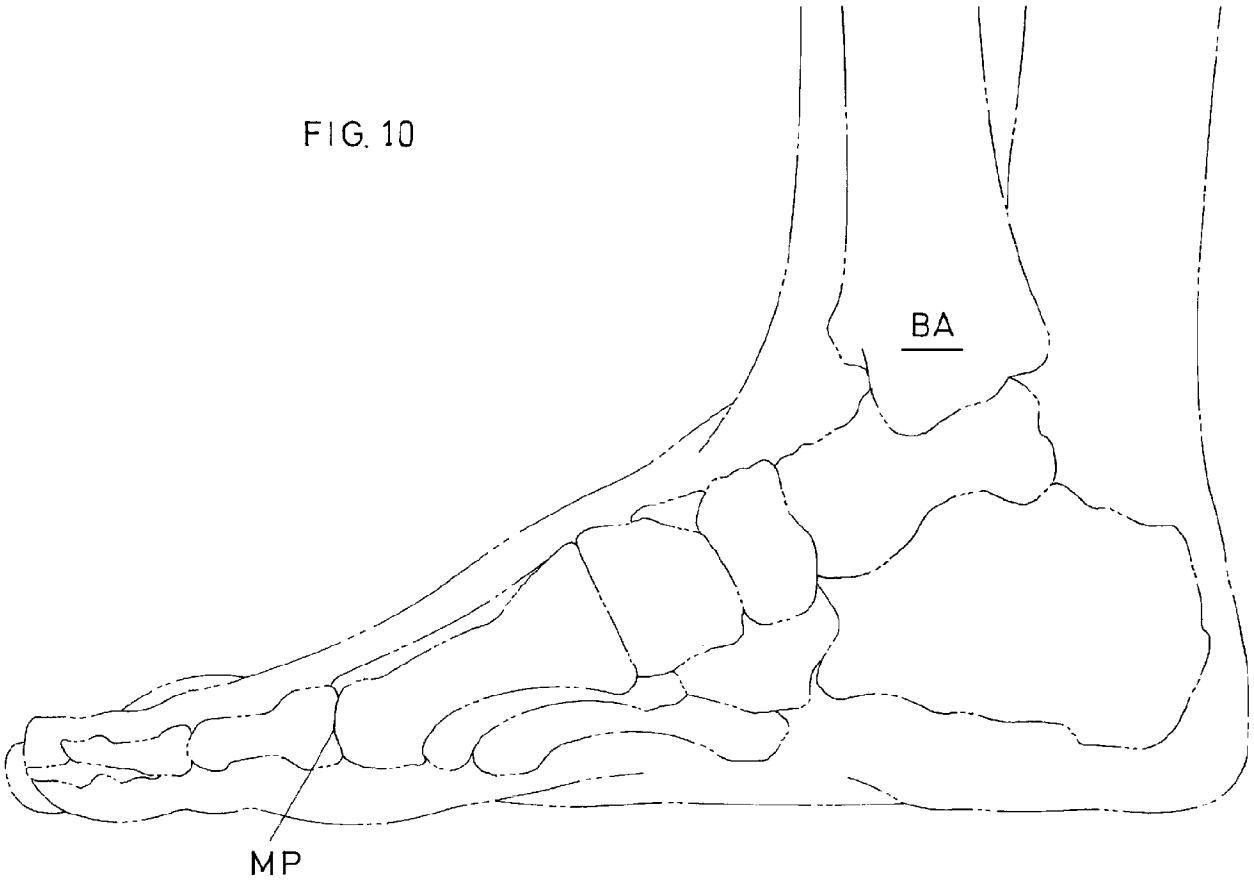
FIG. 10 is a medial side view showing the foot bone structure.

Herein, the instep of the foot refers to an area including the upper surface and the side surface of the foot that is posterior to the metatarsophalangeal joint MP of FIG. 10 and anterior to the front end of the ankle bone BA (more specifically, anterior to the front end of the talus bone). Therefore, the flexible member 3F (FIG. 1) may or may not cover the toe anterior to the metatarsophalangeal joint MP and the heel portion posterior to the front end of the talus bone.

Note that the shoelace 2 is placed on the upper surface of the instep.

Figure 3:
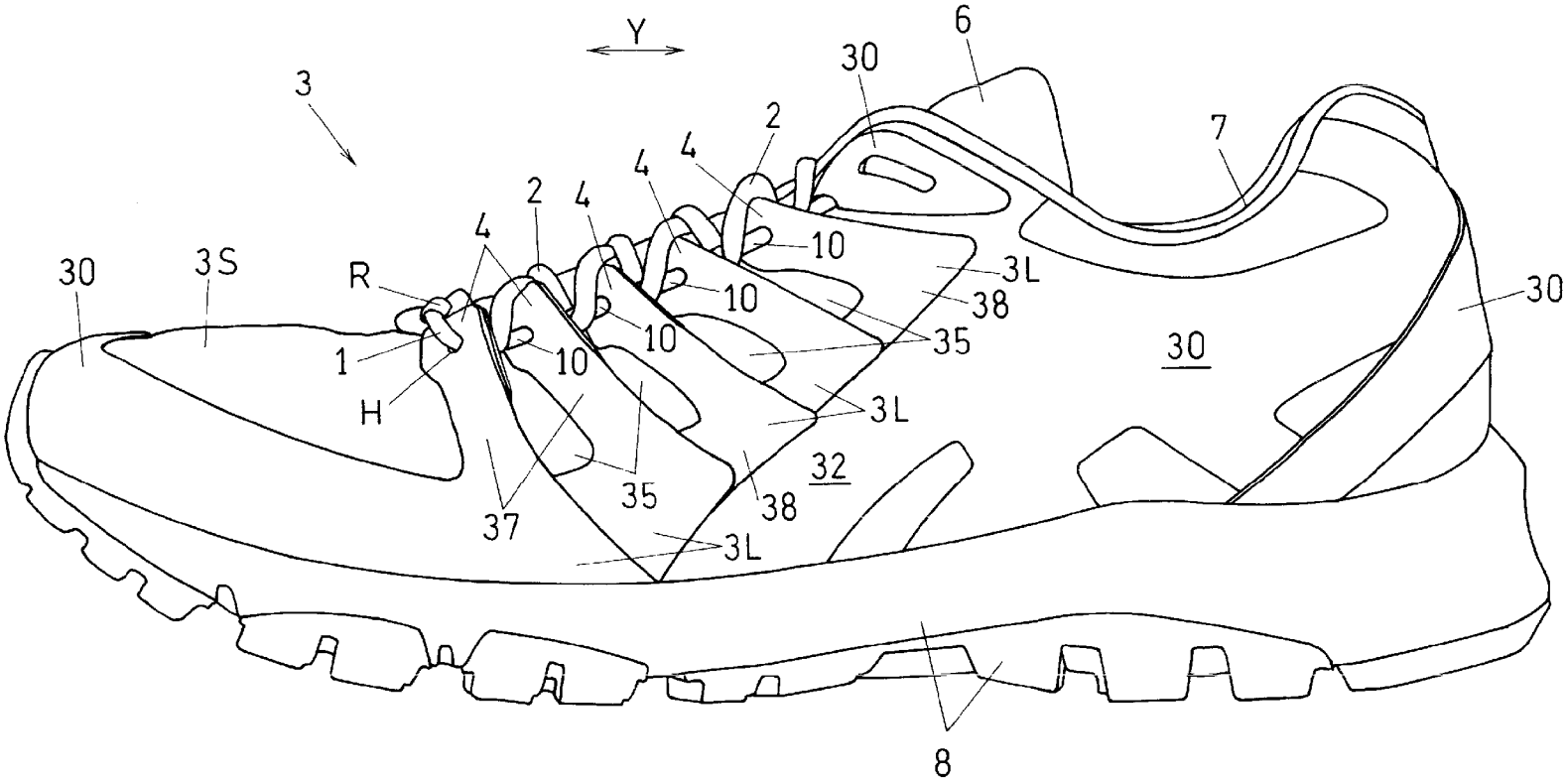
FIG. 3 is a schematic side view of the upper of the embodiment, as seen from the lateral side.

In FIG. 1 to FIG. 3, while the opposite ends of the shoelace 2 are not shown in the figure, the opposite ends are firmly tied together after the foot is inserted into the upper 3. The upper 3 is fitted to the foot as the ends of the shoelace 2 are tied together.

As shown in FIG. 1 to FIG. 3, the upper 3 is provided with a wearing opening 7 through which the foot is inserted when the shoe is put on. The leg protrudes upward through the wearing opening 7 while the shoe is worn, and the area anterior to the wearing opening 7 is covered by the tongue 6.

Figure 5:
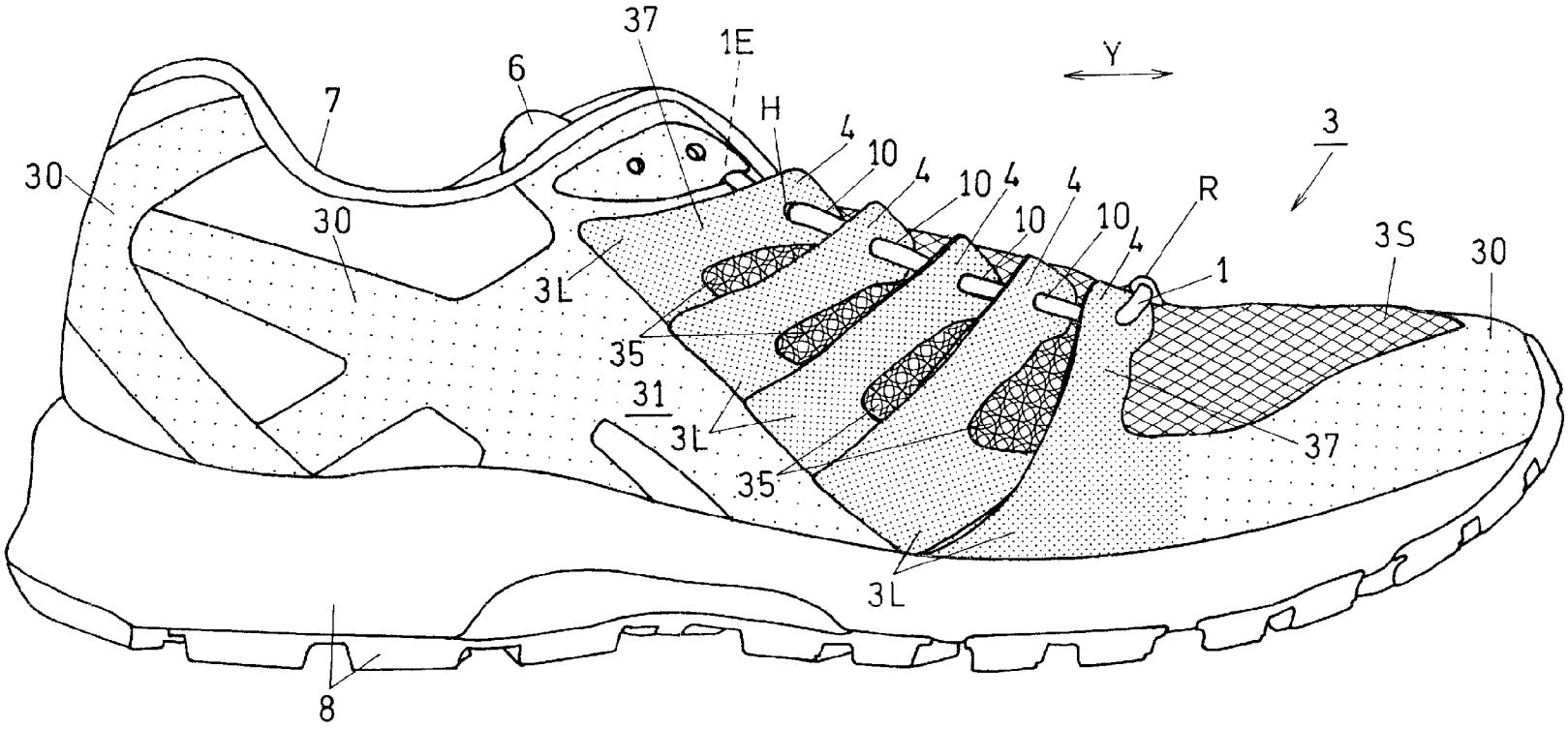
FIG. 5 is a schematic medial side view of the upper, with the shoelace removed.
Figure 6:
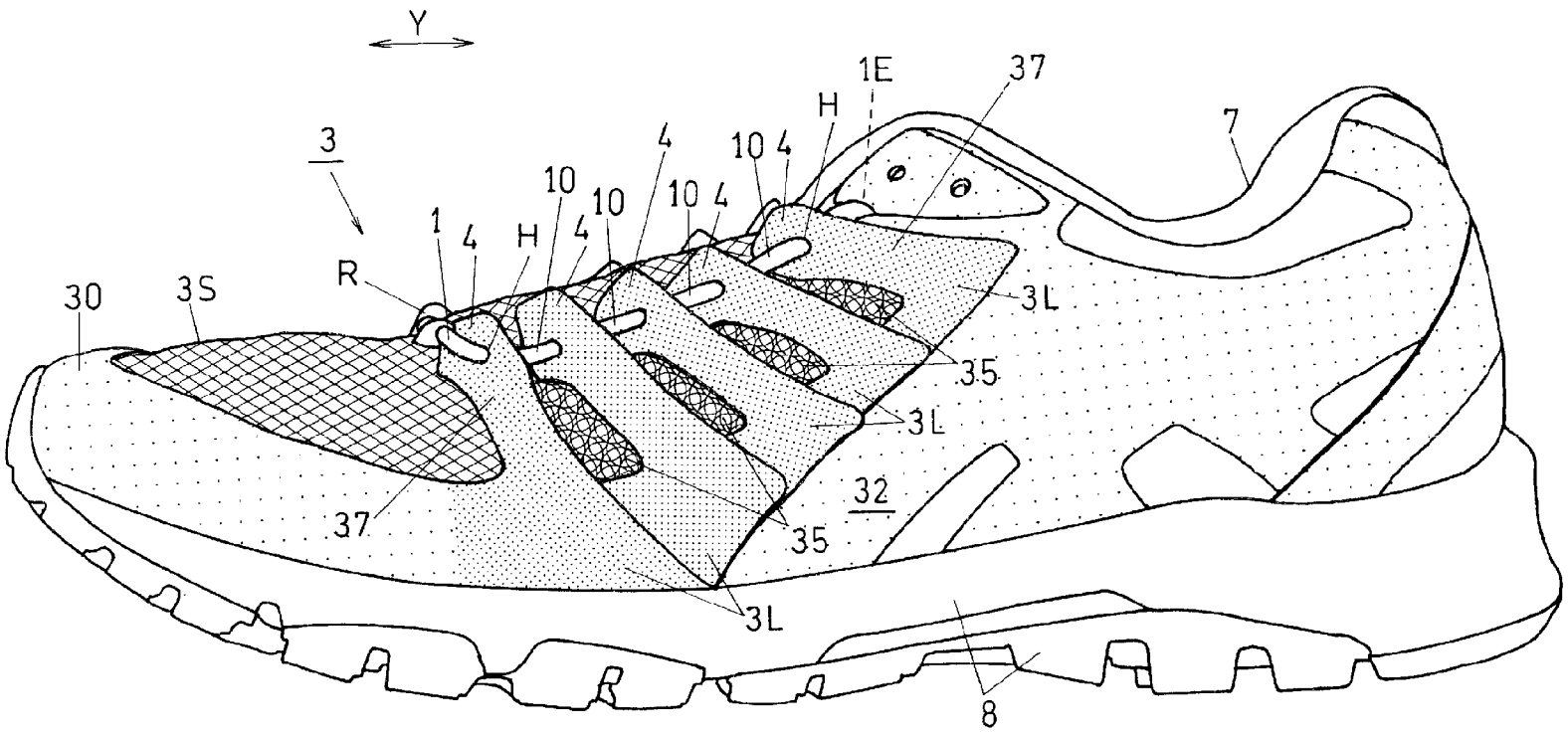
FIG. 6 is a schematic lateral side view of the upper, with the shoelace removed.

In FIG. 5 and FIG. 6, the upper 3 includes a stretchable member 3S, which is different from the flexible member 3F, and another reinforcement member 30, which is separate from a reinforcement member 3L. Note that the reinforcement member 3L and the other reinforcement member 30 may be formed by the same material or by different materials.

In FIG. 5 and FIG. 6, areas where the flexible member 3F is exposed have a geometric pattern thereon, an area where the stretchable member 3S is exposed has a lattice pattern thereon, the reinforcement member 3L of the present invention is dotted densely, and the other reinforcement member 30 is dotted coarsely.

In FIG. 5 and FIG. 6, the reinforcement member 3L of the present invention is attached (secured, fixed) by being sewn, for example, to the surface of the flexible member 3F, which covers the instep from above and from the side. The reinforcement member 3L is arranged on the side surface and the upper surface of the instep.

The other reinforcement member 30 is attached, by being sewn, to the surface of the stretchable member 3S at the toe, for example. Note that the same material as the flexible member 3F, for example, is used for the heel portion, etc., and the other reinforcement member 30 is sewn and attached to these areas.

As can be seen from FIG. 1 to FIG. 6, the flexible member 3F can cover the upper surface, the medial side surface and the lateral side surface of the instep of the foot (not shown). The flexible member 3F is formed by a flexible material. It is preferred that the flexible member 3F is a mesh-like member, for example, and does not substantially stretch (little stretch) in the longitudinal direction Y of FIG. 6 and the transverse direction X (FIG. 1).

The reinforcement members 3L and 30 are formed by a material whose rigidity is greater than the flexible member 3F. That is, it is preferred that the reinforcement members 3L and 30 are less stretchable and have a greater flexural rigidity (bending rigidity) than the flexible member 3F. The material of the reinforcement member 3L may be any of various materials, such as TPU, resin and rubber, as well as artificial leather. On the other hand, the flexible member 3F is formed by a material whose rigidity is smaller than the reinforcement member 3L, and may be more stretchable or have a smaller flexural rigidity than the reinforcement member 3L.

It is preferred that the stretchable member 3S is a meshed member, for example, that stretches/shrinks in the longitudinal direction Y and the transverse direction X (FIG. 1). Note that in order to stably support the instep, it is preferred that a material that stretches/shrinks less than the stretchable member 3S is used for the flexible member 3F.

Figure 7:
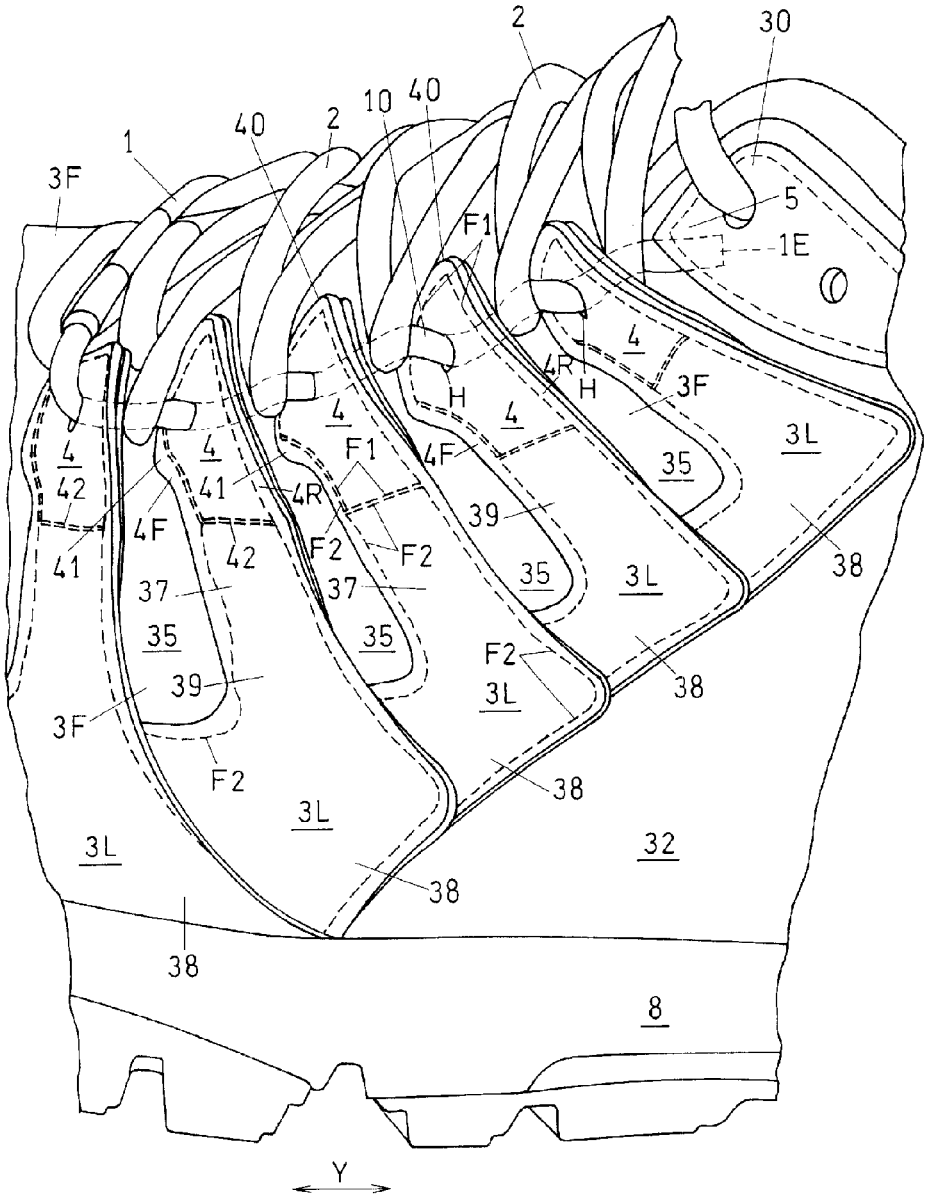
FIG. 7 is an enlarged perspective view showing the lateral side portion in a standstill (stationary standing) position, as seen from a diagonally rearward direction.
Figure 8:
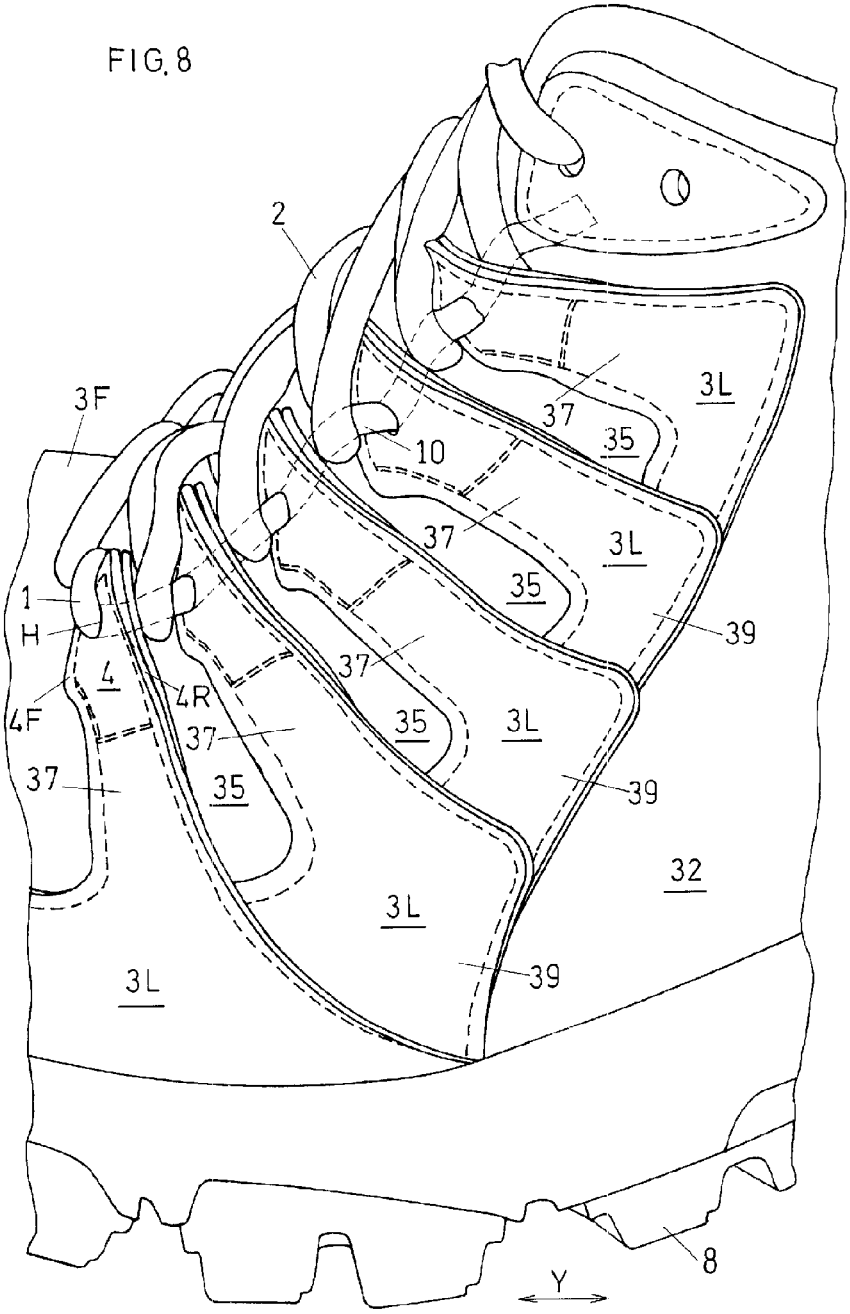
FIG. 8 is an enlarged perspective view showing the lateral side portion when the foot is dorsiflexed, as seen from a diagonally rearward direction.

FIG. 7 and FIG. 8 are views each showing the lateral side portion 32, as seen from a diagonally rearward direction. As shown in FIG. 7, an upper end portion 4 of each of the plurality of reinforcement members 3L has one through hole H running through the reinforcement member 3L in the normal (perpendicular) direction to the surface of the reinforcement member 3L. At least a lower half portion 39 of each reinforcement member 3L is sewn and attached to the surface of the flexible member 3F of the medial side portion 31 and/or the lateral side portion 32.

Each reinforcement member 3L having the through hole H shown in FIG. 7 and FIG. 8 is formed by a synthetic leather, for example, and forms a part of the medial side portion 31 and the lateral side portion 32 together with the flexible member 3F. As shown in FIG. 5 and FIG. 6, a portion of the flexible member 3F that is not covered by the reinforcement member 3L forms a flexible portion 35 and is exposed.

For example, the upper 3 includes a plurality of flexible portions 35 separated from each other in the longitudinal direction by the reinforcement members 3L. Each flexible portion 35 is a portion where the flexible member 3F is not covered by the reinforcement member 3L between adjacent reinforcement members 3L and 3L, and the flexible member 3F is thus exposed.

Figure 4:
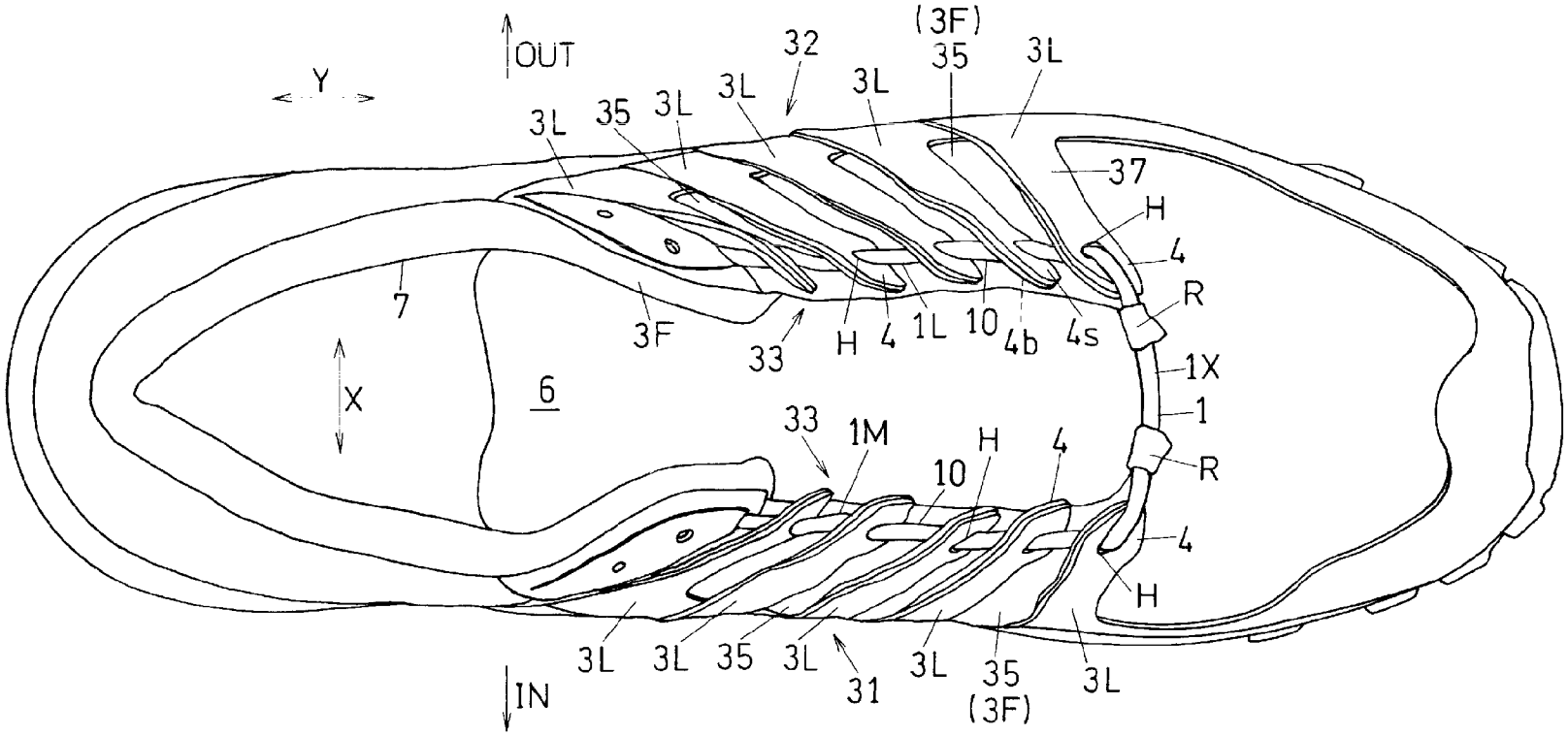
FIG. 4 is a schematic plan view of the upper, with the shoelace removed.

Note that as shown in FIG. 4, the tongue 6 placed between the medial and lateral flexible members 3F is exposed in an area between the medial side portion 31 and the lateral side portion 32, i.e., in a central portion 36 of the instep.

The medial side portion 31 of FIG. 5 covers the instep of the foot and the medial side surface of the big toe (not shown). The front end portion of one reinforcement member 3L of the medial side portion 31 covers the medial side surface of the ball of the big toe, with the other reinforcement member 30 continuous thereto extending in the area anterior thereto.

On the other hand, the lateral side portion 32 of FIG. 6 covers the instep and the lateral side surface of the little toe (not shown). The front end portion of one reinforcement member 3L of the lateral side portion 32 covers the lateral side surface of the ball of the little toe, with the other reinforcement member 30 continuous thereto extending in the area anterior thereto.

That is, the reinforcement member 3L and the other reinforcement member 30 are defined based on the area of the foot to be covered thereby.

Each reinforcement member 3L may extend in a downward direction or a diagonally downward direction along the medial side surface or the lateral side surface. As will be described below, the area of each flexible portion 35 in a state of FIG. 8 in which the shoe is dorsiflexed is smaller than that in a stationary standing position of FIG. 7.

Each reinforcement member 3L having the through hole H of FIG. 6 is placed in a forwardly-leaning orientation, extending in a diagonally rearward direction from the upper end portion 4 toward the sole 8. A posterior one of the reinforcement members 3L is leaning more forward than an anterior one of the reinforcement members 3L. That is, a posterior one (ones) of the reinforcement members 3L forms a smaller angle with a horizontal line than an angle that an anterior one (ones) of the reinforcement members 3L forms with the horizontal line.

In FIG. 7, two reinforcement members 3L that are adjacent to each other in the longitudinal direction Y have their lower end portions 38, opposite from the upper end portions 4, lying continuous with each other in a longitudinal direction or a diagonally longitudinal direction Y in the lower end portions 38.

Each reinforcement member 3L includes a strip portion having a rectangular strip-like shape extending in a diagonally rearward direction from the upper end portion 4 toward the sole 8. The strip portions 37 are spaced apart from each other in the longitudinal direction Y or a diagonally longitudinal direction, with the flexible portion 35 exposed between adjacent strip portions 37. The upper end portion 4, which is the upper end of the strip portion 37, includes a protruding portion 41 protruding forward, for example. In the present embodiment, as shown in the side views of FIG. 2 and FIG. 3, two of the reinforcement members 3L that are adjacent to each other in the longitudinal direction Y overlap with each other via the protruding portion 41 as seen from the side. Note that "as seen from the side (a side view)" may be taken to mean that the shoe is seen directly from a direction perpendicular to the longitudinal axis of the shoe or the foot, i.e., as seen in a side view.

The upper end portion 4 of each reinforcement member 3L of FIG. 7 is attached to the flexible member 3F in one of the fore portion 4F and the rear portion 4R, and is set to be un-attached to the flexible member 3F in the other one of the fore portion 4F and the rear portion 4R. In the present embodiment, the upper end portion 4 of each reinforcement member 3L is attached to the flexible member 3F in the fore portion 4F, and is set to be un-attached to the flexible member 3F in the rear portion 4R. Moreover, the upper end portion 4 is set to be un-attached to the flexible member 3F in a top edge 40 of the upper end portion 4 that is on a top side with respect to the through hole H.

Next, the attached state and the un-attached state of the reinforcement member 3L will be described in detail. Note that the medial side portion 31 and the lateral side portion 32 are similar in structure to each other, and only the lateral side portion 32 will be discussed representatively in the following description.

Figure 9:
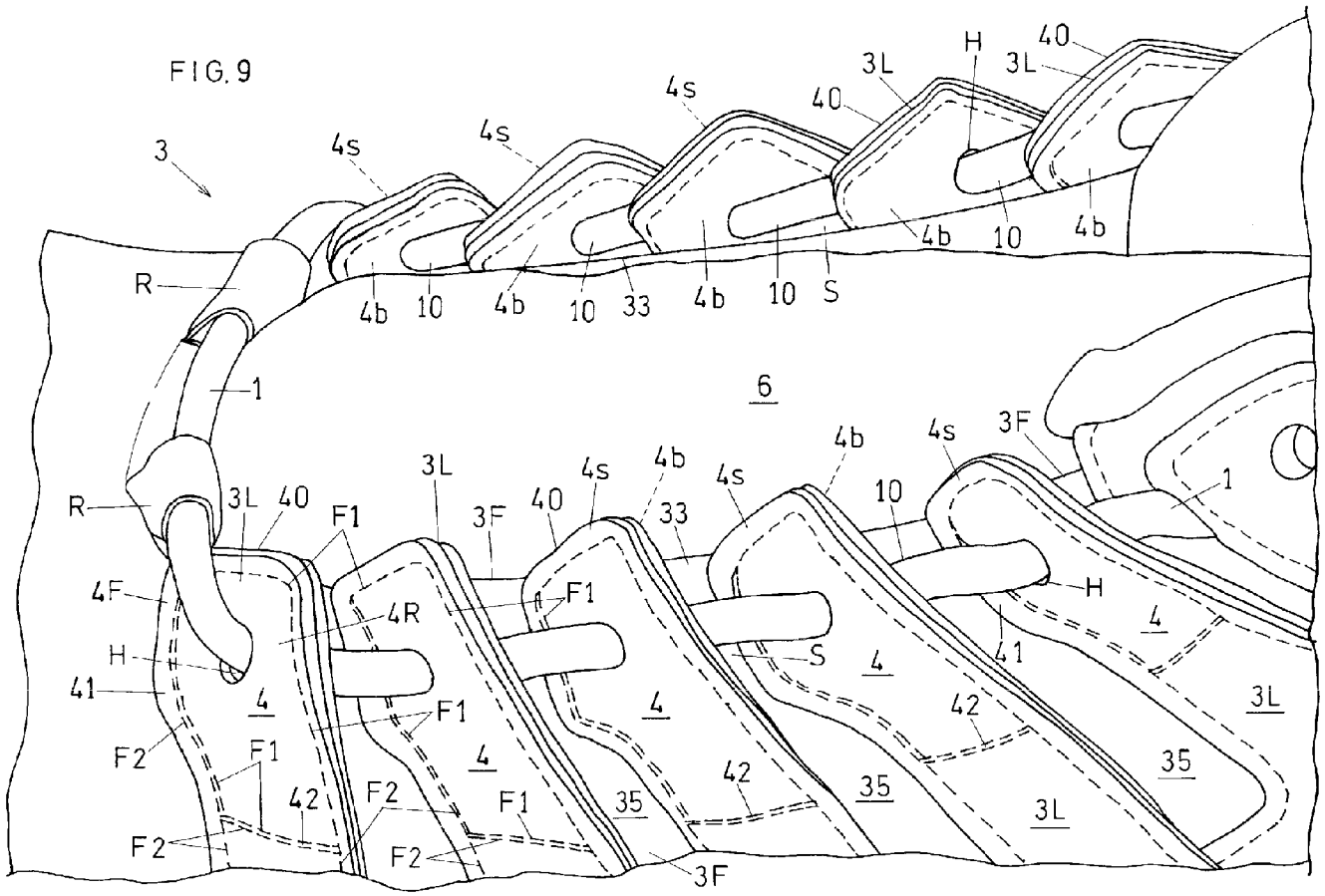
FIG. 9 is an enlarged perspective view showing a main part of the upper, with the shoelace removed.

Broken lines in FIG. 7 to FIG. 9 are not "phantom lines" but are seams made by sewing threads. Note that the thread may be an artificial thread such as a nylon thread, or a natural thread such as a cotton thread.

The upper end portions 4 partially overlap with each other as seen from the normal direction perpendicular to the surface thereof while being spaced apart from each other in the normal direction.

In the present embodiment, the upper end portion 4 of each reinforcement member 3L of FIG. 9 is formed by two sheets of a non-stretchable member, such as an artificial leather, laid on each other. The two sheets of a non-stretchable member are sewn together by a first thread F1 along the top edge 40 of the upper end portion 4 of each reinforcement member 3L, near a lower end boundary 42 of the upper end portion 4 and along the rear portion 4R, while the upper end portion 4 is not sewn to the flexible member 3F by the first thread F1.

Each reinforcement member 3L is sewn to the flexible member 3F by a second thread F2 along the front (fore) edge of each reinforcement member 3L (including the front edge of the upper end portion 4), near the lower end boundary 42 of the upper end portion 4 and along the lower end portion 38 (FIG. 7). Thus, the upper end portion 4 of each reinforcement member 3L of FIG. 9 is attached to the flexible member 3F only along the fore portion 4F (of the top edge 40 on the top side with respect to the through hole H, the fore portion 4F and the rear portion 4R).

In the present invention, the term "attached" may be replaced by the word "secured (fixed)", and it conceptually means that objects are joined together in such a manner that they cannot be removed easily. Specifically, "attached" means that objects are joined together by means of bonding, welding or sewing, or by a combination of two or more of these means.

In the present invention, the term "un-attached (not attached, without attached) state" refers to a free state in which the fore portion 4F or the rear portion 4R is not attached to the flexible member 3F. The fore portion 4F or the rear portion 4R in the un-attached state is not restrained by the flexible member 3F, and may be capable of displacement or deformation, such as twisting or rotation, about the attached portion as the center. On the other hand, portions of the flexible member 3F to which the fore portion 4F or the rear portion 4R is not attached may be capable of such a deformation that wrinkles are produced (three-dimensional deformation) and such a deformation that virtual square shapes turn into diamond shapes (shear deformation) in accordance with deformation of the foot or the upper.

As shown in FIG. 4, the cord 1 is inserted through the through holes H of the medial side portion 31 and the lateral side portion 32 along the edge portion 33, which is a central portion of the medial side portion 31 and the lateral side portion 32, and is placed along the longitudinal direction Y of the foot. Portions of the cord 1 are placed exposed in a plurality of exposed areas 10 spaced apart from each other in the longitudinal direction Y. The cord 1 is placed forward of the wearing opening 7.

Note that in the present embodiment, a pair of loops R for the cord is provided at the front end of the tongue 6, and the cord 1 is placed in a U-shaped pattern, for example.

Thus, a portion of the cord 1 extends continuously over a plurality of exposed areas 10 spaced apart from each other, while being inserted through the through holes H, along the longitudinal direction Y.

The cord 1 of FIG. 5 and FIG. 6 placed in a generally U-shaped pattern as described above has its opposite ends 1E sewn and fixed (secured) to the reinforcement member 30 at fixed portions 5 of FIG. 7. Note that in the present embodiment, the fixed portions 5 are provided at the rear portion of the medial side portion 31 (FIG. 4) and the rear portion of the lateral side portion 32, i.e., in the vicinity of the wearing opening 7 (FIG. 4).

In FIG. 9, between two of the through holes H that are adjacent to each other in the longitudinal direction Y, the cord 1 is placed on the back side 4*b* of one reinforcement member 3L and on the front side 4*s* of the other reinforcement member 3L. Thus, a space S, through which the shoelace 2 passes, is formed between the cord 1 and the flexible member 3F, and as can be seen from FIG. 9, the back side 4*b* of one of the two upper end portions 4 that are adjacent to each other and the front side 4*s* of the other upper end portion 4 are placed at least partially facing each other.

In an area on the medial side IN of the foot and anterior to the wearing opening 7 of FIG. 4, a first portion 1M of the cord 1 is placed exposed in a plurality of exposed areas 10 spaced apart from each other in the longitudinal direction Y. In an area on the lateral side OUT of the foot and anterior to the wearing opening 7, a second portion 1L of the cord 1 is placed exposed in a plurality of exposed areas 10 spaced apart from each other in the longitudinal direction Y.

In the present embodiment, the cord 1 is formed by a single string (strand) arranged in a U-shaped pattern, including a third portion 1X extending in the transverse direction X and connecting together the first portion 1M and the second portion 1L.

Thus, the cord 1 of FIG. 1 forms lacing apertures for the shoelace 2. The shoelace 2 engages with the cord 1 in the exposed areas 10 in the transverse direction X of the foot so as to bring the medial side portion 31 and the lateral side portion 32 closer to each other. That is, the shoelace 2 engages with the first portion 1M and the second portion 1L of the cord 1 in the exposed areas 10 in the transverse direction X of the foot so as to bring the medial side portion 31 and the lateral side portion 32 closer to each other.

In the present embodiment, the cord 1 is formed by a single round string and a metal or resin wire inserted through the round string. On the other hand, the shoelace 2 is formed by a single string (strand, lace) of knitted natural yarn (threads) and/or artificial threads.

Now, the upper end portion 4 of each reinforcement member 3L of FIG. 9 may be attached to the flexible member 3F in only one of the fore portion 4F and the rear portion 4R, among the fore portion 4F, the rear portion 4R, and the top edge 40 on the top side with respect to the through hole H.

Two of the reinforcement members 3L that are adjacent to each other in the longitudinal direction Y do not have to partially overlap with each other as seen from the side.

Next, the behavior of this upper will be described. That is, the behavior of this upper during the transition from the stationary standing position of FIG. 7 into the dorsiflexed state of FIG. 8 in which the heel is off the ground.

Now, when the shoe of FIG. 8 and the foot are dorsiflexed, the hallucal extensor tendon (not shown) of the instep rises upward in the middle foot portion anterior to the ankle bone BA of FIG. 10. Therefore, the inclination angle of the upper surface of the instep varies significantly. At the same time, the upper surface of the instep shrinks when dorsiflexed.

On the other hand, the flexible member 3F of FIG. 8 deforms as if it were shrunk in a direction in conformity with the upper surface of the instep, when dorsiflexed. This deformation may be achieved by the flexible member 3F actually shrinking as well as by the planar surface of the flexible member 3F deforming into a curved surface.

On the other hand, as can be seen from a comparison between FIG. 7 and FIG. 8, the reinforcement members 3L are displaced so that the distance (pitch) between strip portions 37 of the reinforcement member 3L that are adjacent to each other is shortened by the dorsiflexion. Then, at least the lower end portion 38 of the reinforcement member 3L, i.e., the part of the reinforcement member 3L excluding the upper end portion 4, is attached to the surface of the flexible member 3F along its front/rear edge, etc., and the upper end portion 4 is attached thereto along the fore portion 4F. Therefore, the reinforcement member 3L and the flexible member 3F are displaced and deformed as an integral unit. Thus, the behavior of the upper is unlikely to vary, and the instep holding function is unlikely to be detracted from.

As can be seen from a comparison between FIG. 7 and FIG. 8, the angle formed between the surface of the upper end portion 4 and the surface of the flexible portion 35 of FIG. 7 is larger in the dorsiflexed position of FIG. 8 than in the stationary standing position. That is, when transitioning from the stationary standing position to the dorsiflexed position, the surface of the upper end portion 4 is displaced or deformed so as to be rotated (twisted).

Herein, the upper end portion 4 of the reinforcement member 3L is attached to the flexible member 3F in only one of the fore portion 4F and the rear portion 4R. Therefore, the rotation of the upper end portion 4 is unlikely to be hindered. Therefore, one can expect a good fitting property when dorsiflexed.

Next, an alternative example will be described.

The reinforcement members 3L and the flexible portions 35 may be provided only in one of the medial side portion 31 and the lateral side portion 32.

The reinforcement members 3L and the flexible portions 35 do not need to be provided over the entire length of the instep, and they may be provided in the forefoot portion or the middle foot portion of the foot (e.g., they may be provided over one of the first half and the second half of the entire area where the shoelace 2 is placed).

Moreover, the reinforcement member 3L and the flexible portion 35 may be in an asymmetric arrangement between the medial side and the lateral side, e.g., they may be provided in the middle foot portion on the medial side of the foot and provided in the forefoot portion on the lateral side of the foot.

At least one reinforcement member 3L may be a plurality of sheets separately formed with one another and each having one upper end portion 4 and one strip portion 37, which sheets are attached to the flexible member 3F. Alternatively, it may be a single sheet of the reinforcement member 3L with a plurality of upper end portions 4 and a plurality of strip portions integrally (unitary) continuous with the reinforcement member 3L. The through hole H may be formed by a so-called "D-ring" or a synthetic resin C-ring. That is, a member having a through hole therein, such as a D-ring or a C-ring, may be provided at the upper edge of each upper end portion 4, and the cord 1 may be inserted through the D-rings, or the like.

While preferred embodiments have been described above with reference to the drawings, various obvious changes and modifications will readily occur to those skilled in the art upon reading the present specification.

For example, the protruding portion 41 may protrude rearward of the upper end portion 4. The upper end portion 4 does not need to have the protruding portion 41.

The tensile rigidity of the cord 1 may be smaller than that of the shoelace 2 or may be generally equal to that of the shoelace 2.

The sole placed under the upper may include only the so-called "outsole".

The upper may be of a high-cut type, not a low-cut type.

The tongue in the central portion of the upper may be absent.

Thus, such changes and modifications are deemed to fall within the scope of the present invention, which is defined by the appended claims.

INDUSTRIAL APPLICABILITY

The present invention is applicable to shoes having a lace fitting structure using a shoelace.

REFERENCE SIGNS LIST

1: Cord 1M: First portion 1L: Second portion 1X: Third portion 1E: End 10: Exposed area (engagement area)
2: Shoelace
3: Upper 3F: Flexible member 3S: Stretchable member 3L: Reinforcement member 30: Reinforcement member 31: Medial side portion 32: Lateral side portion 33: Edge portion 35: Flexible portion 36: Central portion 37: Strip portion 38: Lower end portion 39: Lower half portion
4: Upper end portion 4*b*: Back side 4*s*: Front side 4F: Fore portion 4R: Rear portion 40: Top edge 41: Protruding portion 42: Boundary
5: Fixed portion 6: Tongue 7: Wearing opening 8: Sole
F1: First thread F2: Second thread
H: Through hole R: Loop S: Space
X: Transverse direction y: Longitudinal direction OUT: Lateral direction IN: Medial direction

The invention claimed is:

1. A shoe upper configured to cover at least a portion of a foot instep, the upper comprising:

a medial side portion configured to cover a medial side surface of the instep;

a lateral side portion configured to cover a lateral side surface of the instep;

at least one flexible member covering at least one of (i) a portion of the instep in the medial side portion and (ii) a portion of the instep in the lateral side portion;

at least one reinforcement member having a greater rigidity than the at least one flexible member, at least a lower half portion of at least one reinforcement member being attached to at least one of (i) a surface of at least one flexible member in the medial side portion, and (ii) a surface of at least one flexible member in the lateral side portion, wherein the at least one reinforcement member includes a plurality of upper end portions spaced apart from one another in a longitudinal direction of the foot, and wherein a through hole is defined in each upper end portion of the at least one reinforcement member and extends in a normal direction with respect to a surface of the at least one reinforcement member;

a cord provided along a central edge portion of at least one of (i) the medial side portion and (ii) the lateral side portion, the cord inserted through each through hole of at least one of (i) the medial side portion and (ii) the lateral side portion, the cord extending along the longitudinal direction, wherein portions of the cord include exposed areas; and a shoelace engaging with the cord in the exposed areas in a transverse direction of the foot so as to relatively move the medial side portion and the lateral side portion closer to each other, wherein each upper end portion of the at least one reinforcement member is attached to the flexible member in only one of (i) a fore portion and (ii) a rear portion, of each upper end portion.

2. The upper according to claim 1, wherein the at least one reinforcement member is attached to the flexible member in only one of (i) the fore portion, (ii) the rear portion, and (iii) a top portion above the through hole.

3. The upper according to claim 1, wherein one of the following (a) and (b) is set:

(a) each upper end portion of the at least one reinforcement member is attached to the flexible member in the fore portion, and is not attached to the flexible member in the rear portion, (b) each upper end portion of the at least one reinforcement member is attached to the flexible member in the rear portion, and is not attached to the flexible member in the fore portion.

4. The upper according to claim 1, wherein each upper end portion is not attached to the flexible member above the through hole.

5. The upper according to claim 1, wherein, between two of the through holes that are adjacent to each other in the longitudinal direction, the cord extends (i) under a back side of one of the upper end portions and (ii) across a front side of another one of the upper end portions, thereby forming, between the cord and the flexible member, a space, through which the shoelace passes.

6. The upper according to claim 1, wherein:

between two through holes that are adjacent to each other in the longitudinal direction, the cord extends (i) under a back side of one of the upper end portions and (ii) across a front side of another one of the upper end portions, whereby, of two upper end portions that are adjacent to each other, the back side of the one of the upper end portions and the front side of the other one of the upper end portions are disposed at least partially facing each other.

7. The upper according to claim 6, wherein: the shoelace passes through a space formed between the cord and the flexible member.

8. The upper according to claim 1, wherein a tensile rigidity of the cord is greater than a tensile rigidity of the shoelace.

9. The upper according to claim 1, wherein two of the upper end portions that are adjacent to each other in the longitudinal direction partially overlap with each other as seen from a side view.

10. The upper according to claim 1, wherein:

the at least one reinforcement member includes a strip portion extending from each upper end portion toward a shoe sole; and an upper end of the strip portion includes a protruding portion which protrudes in at least one of (i) a forward direction and (ii) a rearward direction.

11. The upper according to claim 10 wherein: two upper end portions that are adjacent to each other in the longitudinal direction overlap with each other via the protruding portion as seen from a side view.

12. The upper according to claim 1, wherein:

the at least one reinforcement member includes a plurality of strip portions each extending in at least one of (i) a downward direction and (ii) a diagonally downward direction; and the upper further comprises a flexible portion where the flexible member is exposed between two of the strip portions that are adjacent to each other in the longitudinal direction.

13. The upper according to claim 1, wherein:

each upper end portion is disposed in a forwardly-tilting orientation, extending in a diagonally rearward direction from each upper end portion toward a shoe sole; and a posterior one of the upper end portions tilts more forward than an anterior one of the upper end portions.

14. The upper according to claim 1, wherein:

the at least one reinforcement member includes a plurality of strip portions each extending from corresponding upper end portions in one of (i) a downward direction and (ii) a diagonally downward direction; and at least two of the strip portions that are adjacent to each other in the longitudinal direction have lower end portions which are continuous with each other.

15. A shoe upper configured to cover at least a portion of a foot instep, the upper comprising:

a medial side portion configured to cover a medial side surface of the instep;

a lateral side portion configured to cover a lateral side surface of the instep;

at least one flexible member covering at least one of (i) a portion of the instep in the medial side portion and (ii) a portion of the instep in the lateral side portion;

at least one reinforcement member having a greater rigidity than the at least one flexible member, at least a lower half portion of at least one reinforcement member being attached to at least one of (i) a surface of at least one flexible member in the medial side portion, and (ii) a surface of at least one flexible member in the lateral side portion, wherein the at least one reinforcement member includes a plurality of upper end portions spaced apart from one another in a longitudinal direction of the foot, and wherein a through hole is defined in each upper end portion of the at least one reinforcement member and extends in a normal direction with respect to a surface of the at least one reinforcement member;

a cord provided along a central edge portion of at least one of (i) the medial side portion and (ii) the lateral side portion, the cord inserted through each through hole of at least one of (i) the medial side portion and (ii) the lateral side portion, the cord extending along the longitudinal direction, wherein portions of the cord include exposed areas; and a shoelace engaging with the cord in the exposed areas in a transverse direction of the foot so as to relatively move the medial side portion and the lateral side portion closer to each other, wherein each upper end portion of the at least one reinforcement member is attached to the flexible member in at least one of (i) a fore portion and (ii) a rear portion, of each upper end portion, wherein, between two through holes that are adjacent to each other in the longitudinal direction, the cord extends (i) under a back side of one of the upper end portions and (ii) across a front side of another one of the upper end portions, whereby, of two upper end portions that are adjacent to each other, the back side of the one of the upper end portions and the front side of the other one of the upper end portions are disposed at least partially facing each other.

16. The upper according to claim 15, wherein the shoelace passes through a space formed between the cord and the flexible member.

17. A shoe upper configured to cover at least a portion of a foot instep, the upper comprising:

a medial side portion configured to cover a medial side surface of the instep;

a lateral side portion configured to cover a lateral side surface of the instep;

at least one flexible member covering at least one of (i) a portion of the instep in the medial side portion and (ii) a portion of the instep in the lateral side portion;

at least one reinforcement member having a greater rigidity than the at least one flexible member, at least a lower half portion of at least one reinforcement member being attached to at least one of (i) a surface of at least one flexible member in the medial side portion, and (ii) a surface of at least one flexible member in the lateral side portion, wherein the at least one reinforcement member includes a plurality of upper end portions spaced apart from one another in a longitudinal direction of the foot, and wherein a through hole is defined in each upper end portion of the at least one reinforcement member and extends in a normal direction with respect to a surface of the at least one reinforcement member;

a cord provided along a central edge portion of at least one of (i) the medial side portion and (ii) the lateral side portion, the cord inserted through each through hole of at least one of (i) the medial side portion and (ii) the lateral side portion, the cord extending along the longitudinal direction, wherein portions of the cord include exposed areas; and a shoelace engaging with the cord in the exposed areas in a transverse direction of the foot so as to relatively move the medial side portion and the lateral side portion closer to each other, wherein each upper end portion of the at least one reinforcement member is attached to the flexible member in at least one of (i) a fore portion and (ii) a rear portion, of each upper end portion, and wherein two of the upper end portions that are adjacent to each other in the longitudinal direction partially overlap with each other as seen from a side view.

18. A shoe upper configured to cover at least a portion of a foot instep, the upper comprising:

a medial side portion configured to cover a medial side surface of the instep;

a lateral side portion configured to cover a lateral side surface of the instep;

at least one flexible member covering at least one of (i) a portion of the instep in the medial side portion and (ii) a portion of the instep in the lateral side portion;

at least one reinforcement member having a greater rigidity than the at least one flexible member, at least a lower half portion of at least one reinforcement member being attached to at least one of (i) a surface of at least one flexible member in the medial side portion, and (ii) a surface of at least one flexible member in the lateral side portion, wherein the at least one reinforcement member includes a plurality of upper end portions spaced apart from one another in a longitudinal direction of the foot, and wherein a through hole is defined in each upper end portion of the at least one reinforcement member and extends in a normal direction with respect to a surface of the at least one reinforcement member;

a cord provided along a central edge portion of at least one of (i) the medial side portion and (ii) the lateral side portion, the cord inserted through each through hole of at least one of (i) the medial side portion and (ii) the lateral side portion, the cord extending along the longitudinal direction, wherein portions of the cord include exposed areas; and a shoelace engaging with the cord in the exposed areas in a transverse direction of the foot so as to relatively move the medial side portion and the lateral side portion closer to each other, wherein each upper end portion of the at least one reinforcement member is attached to the flexible member in at least one of (i) a fore portion and (ii) a rear portion, of each upper end portion, wherein the at least one reinforcement member includes a strip portion extending from each upper end portion toward a shoe sole; and an upper end of the strip portion includes a protruding portion which protrudes in at least one of (i) a forward direction and (ii) a rearward direction.

* * * * *